US011598233B2

(12) United States Patent
Maier

(10) Patent No.: US 11,598,233 B2
(45) Date of Patent: Mar. 7, 2023

(54) DIAGNOSABLE CONNECTOR DEVICE OF A VENTILATING DEVICE FOR AN INTERNAL COMBUSTION ENGINE

(71) Applicant: Bayerische Motoren Werke Aktiengesellschaft, Munich (DE)

(72) Inventor: Johannes Maier, Tuntenhausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/252,162

(22) PCT Filed: Jun. 12, 2019

(86) PCT No.: PCT/EP2019/065342

§ 371 (c)(1),
(2) Date: Dec. 14, 2020

(87) PCT Pub. No.: WO2020/011473

PCT Pub. Date: Jan. 16, 2020

(65) Prior Publication Data

US 2021/0254521 A1 Aug. 19, 2021

(30) Foreign Application Priority Data

Jul. 11, 2018 (DE) ..... 10 2018 211 450.1

(51) Int. Cl.
*F01M 13/04* (2006.01)
*F01M 13/02* (2006.01)
*F01M 5/00* (2006.01)

(52) U.S. Cl.
CPC ..... *F01M 13/023* (2013.01); *F01M 5/001* (2013.01)

(58) Field of Classification Search
CPC ..... F01M 13/04; F01M 13/00; F01M 11/02; F01M 13/022; F01M 13/023; F01M 2013/0083; F01M 2013/0044
(Continued)

(56) References Cited

U.S. PATENT DOCUMENTS 2,481,713 A * 9/1949 Bertea ..... F16K 15/044 137/515.5
3,664,368 A * 5/1972 Sweeney ..... B08B 7/02 137/480
(Continued)

FOREIGN PATENT DOCUMENTS

CN 101495720 A 7/2009
CN 205101142 U * 3/2016
(Continued)

OTHER PUBLICATIONS

CN 205101142 U—English Translation (Year: 2016).*
(Continued)

*Primary Examiner* — George C Jin
*Assistant Examiner* — Teuta B Holbrook
(74) *Attorney, Agent, or Firm* — Crowell & Moring LLP

(57) ABSTRACT

A connection device for connecting a ventilating line to an intake air flow guide of an internal combustion engine, wherein the connection device has a non-return valve for preventing a flow from the intake air flow guide into the ventilating line. The connection device has at least one hole which is arranged upstream of the non-return valve and connects an interior chamber of the connection device to a surrounding area of the connection device.

8 Claims, 2 Drawing Sheets

(58) Field of Classification Search
USPC ..... 123/572, 573, 574
See application file for complete search history.

(56) References Cited

U.S. PATENT DOCUMENTS

| | | | | | |
|---|---|---|---|---|---|
| 3,805,755 | A * | 4/1974 | Miles | F01M 13/023 | 123/556 |
| 4,768,493 | A * | 9/1988 | Ohtaka | F01P 3/20 | 123/573 |
| 4,785,874 | A * | 11/1988 | Avrea | F01P 11/0285 | 165/917 |
| 6,044,829 | A * | 4/2000 | Butz | F16K 49/002 | 123/573 |
| 6,546,921 | B1 * | 4/2003 | Callahan | F02M 25/06 | 123/573 |
| 6,581,583 | B2 * | 6/2003 | Leen | F02M 31/14 | 123/573 |
| 6,883,538 | B2 * | 4/2005 | Toyokawa | F16L 41/088 | 123/574 |
| 7,263,984 | B2 * | 9/2007 | Wade | F01M 13/0011 | 123/572 |
| 7,275,527 | B2 * | 10/2007 | Bruchner | F01M 13/025 | 123/572 |
| 7,311,091 | B2 * | 12/2007 | Duprez | F02M 25/06 | 123/574 |
| 7,316,226 | B2 * | 1/2008 | Callahan | F02M 25/06 | 123/572 |
| 8,371,279 | B2 * | 2/2013 | Doers | F01M 13/021 | 123/574 |
| 10,006,325 | B2 * | 6/2018 | Okazaki | F01M 13/0011 | |
| 2004/0084091 | A1 * | 5/2004 | Kerger | F16K 1/303 | 137/538 |
| 2004/0231651 | A1 * | 11/2004 | Wade | F16L 53/38 | 123/573 |
| 2006/0027218 | A1 * | 2/2006 | Cripps | F02M 25/06 | 123/574 |
| 2006/0180132 | A1 * | 8/2006 | Zhao | F02M 25/06 | 123/574 |
| 2007/0240690 | A1 * | 10/2007 | Nanba | F02M 26/74 | 123/568.24 |
| 2008/0092864 | A1 * | 4/2008 | Suzuki | F01M 13/023 | 123/574 |
| 2008/0099000 | A1 * | 5/2008 | Suzuki | F02B 25/00 | 123/574 |
| 2011/0203559 | A1 * | 8/2011 | Tanikawa | F01M 13/0011 | 123/572 |
| 2012/0048401 | A1 * | 3/2012 | Yamashita | F16K 15/04 | 137/528 |
| 2015/0345351 | A1 * | 12/2015 | Mincher | F01M 13/0011 | 55/462 |
| 2016/0024983 | A1 * | 1/2016 | Jones | F02M 25/06 | 123/574 |
| 2016/0123199 | A1 * | 5/2016 | Yamada | F01M 13/0011 | 123/574 |
| 2016/0230626 | A1 * | 8/2016 | Lorentz | F01M 13/023 | |
| 2018/0216506 | A1 * | 8/2018 | Maas | F02M 25/06 | |

FOREIGN PATENT DOCUMENTS

| | | | | | |
|---|---|---|---|---|---|
| CN | 105545411 | A | | 5/2016 | |
| CN | 107939477 | A | * | 4/2018 | |
| DE | 102005043735 | A1 | * | 3/2007 | F01M 13/0011 |
| DE | 103 10 182 | B4 | | 11/2008 | |
| DE | 10 2007 053 507 | A1 | | 1/2009 | |
| DE | 10 2009 008 831 | A1 | | 8/2010 | |
| DE | 10 2014 102 596 | A1 | | 6/2015 | |
| DE | 10 2016 201 589 | B3 | | 6/2017 | |
| DE | 10 2016 202 140 | A1 | | 8/2017 | |
| DE | 102017000936 | A1 | * | 8/2017 | F16K 15/144 |
| EP | 1213451 | A1 | * | 6/2002 | F01M 13/023 |
| EP | 2 418 361 | B1 | | 9/2015 | |
| FR | 1309312 | A | | 11/1962 | |
| FR | 1344191 | A | | 11/1963 | |
| JP | 10103040 | A | * | 4/1998 | F01M 13/04 |
| JP | 2009-103117 | A | | 5/2009 | |
| KR | 20170073355 | A | * | 6/2017 | |

OTHER PUBLICATIONS

International Search Report (PCT/ISA/210) issued in PCT Application No. PCT/EP2019/065342 dated Aug. 27, 2019 with English translation (four (4) pages).

German-language Written Opinion (PCT/ISA/237) issued in PCT Application No. PCT/EP2019/065342 dated Aug. 27, 2019 (five (5) pages).

German-language Office Action issued in German Application No. 10 2018 211 450.1 dated May 9, 2019 with English translation (12 pages).

German-language Decision to Grant issued in German Application No. 10 2018 211 450.1 dated May 9, 2019 with English translation (26 pages).

German-language Decision to Grant issued in German Application No. 10 2018 211 450.1 dated Jul. 10, 2019 with English translation (26 pages).

Chinese Office Action issued in Chinese application No. 201980031632.5 dated Nov. 1, 2021, with English Translation (Fifteen (15) pages).

* cited by examiner

DIAGNOSABLE CONNECTOR DEVICE OF A VENTILATING DEVICE FOR AN INTERNAL COMBUSTION ENGINE

BACKGROUND AND SUMMARY OF THE INVENTION

The present invention relates to a ventilation device for an internal combustion engine having a first connection device for direct or indirect connection to a crankcase, a second connection device for connection to a component which guides the supply air flow and a ventilation line which connects the first connection device to the second connection device.

Such ventilation devices are already known in the prior art and are used, for example, in internal combustion engines. Such internal combustion engines are used, for example, in motor vehicles, working machines, aircraft or similar piston-driven applications. In piston-driven internal combustion engines, it is necessary to discharge gas, which is produced during the combustion process and which accumulates as a result of leaks at the piston in a crankcase, via a ventilation device into the intake region of the internal combustion engine. This gas which is often also known as "blow-by-gas" or combustion gas must be directed out of the crankcase of the engine in order to prevent a pressure build-up in the crankcase. In this instance, it is not possible to discharge the unprocessed gas directly into the environment. Instead, the gas must be directed out of the crankcase of the engine in order to be subjected to a selective reprocessing operation.

Such a reprocessing operation is often configured in such a manner that the combustion gas which is discharged from the crankcase is supplied for repeated combustion in the combustion chamber. To this end, it is conventional to discharge the gas via a ventilation device. In the case of a supercharged internal combustion engine, a plurality of ventilation devices are generally required in order, both in the non-supercharged engine operating state, in which there is a reduced pressure applied between the throttle valve and the combustion chamber, and in the supercharged engine operating state, in which there is excess pressure applied between the throttle valve and the combustion chamber, to ensure a ventilation of the crankcase. The ventilation device for the non-supercharged engine operating state directs the combustion gas between the throttle valve and combustion chamber into the supply air flow. The ventilation device for the supercharged engine operating state directs the combustion gas upstream of the compressor into the supply air flow. The ventilation lines which belong to these ventilation devices are to this end connected by means of a first connection device in technical guiding terms directly or indirectly to the crankcase and by means of a second connection device connected in technical guiding terms to a component which guides the supply air flow (also referred to as the supply air flow guide) in order to direct the combustion gas to the component which guides the supply air flow, where it is introduced into a supply air flow of the internal combustion engine and is mixed therewith.

Furthermore, in specific countries, it may be necessary, using a diagnostic device, also referred to as on-board diagnostics (OBD), which is connected to a diagnostic interface, to verify whether the ventilation device is operating correctly. To this end, the vehicle must have a self-diagnostic device by means of which the correct function of the ventilation device for the internal combustion engine and consequently the correct return of the gases which have accumulated in the crankcase into the supply air flow guide of the internal combustion engine can be monitored. A corresponding device for carrying out this diagnosis by monitoring the reduced pressure in a ventilation device is known from DE 10 2016 201 589 B3. Using this, the complete space which is connected in technical guiding terms can be monitored. In the case of a supercharged internal combustion engine, the ventilation devices have to be provided with non-return valves in order to prevent the supply air flow from being directed via the ventilation device. The space which can be diagnosed by monitoring the reduced pressure terminates at these non-return valves since the reduced pressure continues only as far as these valves. In order to enable the diagnosis of a ventilation device up to the component which guides the supply air flow, it is therefore necessary to ensure that the non-return valve is located on the component which guides the supply air flow.

It is further known that the gases which are intended to be discharged from the crankcase have an occasionally high proportion of moisture. Depending on the ambient temperature and engine operating state, therefore, it may be necessary to heat a ventilation device in order, for example, in winter during a cold start phase to prevent freezing, in particular of the connection device, to the component which guides the supply air flow. Particularly at risk of freezing are any non-return valves which are contained in the ventilation device. If the non-return valve is located as described above on the component which guides the supply air flow, a heating accordingly has to be carried out at this location.

An object of the present invention is to provide a solution which is as simple and reliable as possible and in particular to provide a connection device which can be adapted to different requirements and installed in the vehicle in the simplest manner possible.

These objectives are achieved with a connection device according to the features of the independent claims. Other advantageous embodiments of the invention are set out in the dependent claims. It should be noted that the features set out individually in the dependent patent claims can be combined with each other in any technologically advantageous manner and define other embodiments of the invention.

Furthermore, the features set out in the patent claims are specified and explained in greater detail in the description, wherein additional preferred embodiments of the invention are set out.

There is intended to be described herein a connection device for connecting a ventilation line to a supply air flow guide of an internal combustion engine, wherein the connection device has a non-return valve for preventing a flow from the supply air flow guide into the ventilation line, wherein the connection device further has at least one hole which is arranged upstream of the non-return valve and which connects an inner space of the connection device to an environment of the connection device.

The connection device is as described suitable for connecting a ventilation line to a supply air flow guide. The supply air flow guide is a supply line by means of which air (in particular clean air) is supplied to the combustion chambers of an internal combustion engine. The connection device is a type of plug connector, which forms the end of the ventilation line and which can be inserted into a corresponding receiving member or into a corresponding counter-piece on the supply air flow guide. Such a counter-piece for the connection device is also referred to below as a supply air flow guide connection.

The term "inner space" describes the inner workings of the connection device, in which the ventilation line opens and through which the gas which flows through the ventilation line flows. The term "environment" refers to an outer region (which is arranged at the outer side of an outer face of the connection device).

The present connection device solves the described problems in that this device is constructed by the interface which can be diagnosed using the methodology in DE 10 2016 201 589 B3. To this end, the portion of the connection device which belongs to the ventilation line is provided with one or more apertures (the holes mentioned), whereby a defined leak is brought about and can be diagnosed. As a result of this leak, it can be determined that the connection device is not correctly secured in the air flow connection. Preferably, the connection device and the supply air flow guide connection are constructed in such a manner that the hole is closed when the connection device is correctly secured to the air flow connection. The hole thus forms a defined leakage location. This leakage location can be closed only by the ventilation line being joined to the corresponding counter-piece (the air flow guide connection) of the respective connection device.

It is consequently ensured that any separation of the connection device is recognized so that it can be proven that the ventilation line is located on the corresponding counter-piece of the respective connection device. The present invention is therefore quite particularly advantageous in that it is possible to integrate a non-return valve in the ventilation line instead of in a component which leads to the supply air flow. It is further advantageous that consequently the heating of the connection device and the non-return valve may also be a component of the ventilation line. Variants of the ventilation device with/without a non-return valve or with/without heating can consequently be constituted purely via the ventilation line and have no influence on the counter-piece of the respective connection device.

The connection device and the ventilation line preferably form together a type of ventilation device which serves, for example, to ventilate a crankcase of an internal combustion engine or a tank. Preferably, the ventilation device also comprises another connection device which is located at another end of the ventilation line which is opposite the connection device. This additional connection device serves to connect the ventilation line of the ventilation device to the described crankcase or to the described tank.

The ventilation device from the first connection device as far as the second connection device preferably forms a sub-assembly. When the ventilation device is installed, the first connection device, the second connection device or the ventilation device do not have to be assembled with each other, but instead are provided in a pre-assembled state. In preferred construction variants, a destruction-free disassembly of the ventilation device is not possible, for example, since the ventilation line and the connection devices are cast with each other or adhesively bonded.

With the integration of the interface in the ventilation line, the final assembly is additionally simplified since no further actions are required to assemble the interface and ventilation line. The susceptibility to failure in the context of assembly and also the complexity of the goods logistics are thereby considerably reduced. Furthermore, an adaptation of the ventilation line can be carried out by only the portion of the interface which is integrated in the ventilation line being adapted. The term "integrated" is intended to be understood to mean in this context that the interface is spatially at least for the most part arranged within the ventilation line and is surrounded thereby.

It is particularly advantageous for a first heating device to be integrated in the connection device.

It is further advantageous for the first heating device to be constructed as an electrical heating element.

As has already been described above, a heating unit serves to regularly heat the non-return valve in the connection device in order to prevent ice forming on the non-return valve even in unfavorable operating phases of the combustion engine in this regard.

It is further advantageous for the non-return valve to be arranged directly downstream of a hole.

It is also advantageous for there to be arranged on an outer face of the connection device at least one sealing means, which seals the hole when the first connection device is connected to a supply air flow guide connection on a supply air flow guide.

Such a sealing means corresponds in particular to a sealed region in a clean air line connection.

Such a sealing agent may, for example, comprise grooves and O-rings or sealing lips which are arranged on the outer periphery and which rest on the sealed region on the supply air flow guide connection in order to form a sealed closure of the hole and are arranged in an opening region of the ventilation line at the first interface. It is thereby possible to integrate the diagnosable interface in the ventilation line in a fluid-tight manner. The sealing system may in this instance, for example, be configured in such a manner that it is subsequently inserted in a particularly simple manner into the ventilation line together with the diagnosable interface. For example, during production of the ventilation line, the grooves may also be directly injection-molded.

Preferably, there are provided on the connection device (on an outer peripheral face) two peripheral O-rings which seal within the clean air line connection. Between the two O-rings, a plurality of holes are preferably circumferentially arranged. For example, 2, 4 or six holes may be arranged circumferentially.

A supply air flow guide for an internal combustion engine having a supply air flow guide connection for a connection device having a ventilation line according to one of the preceding claims is also intended to be described here.

The supply air flow guide having the supply air flow guide connection is configured to cooperate with the ventilation device or the connection device for the ventilation device in order to enable a secure and gas-tight introduction of gas from the ventilation device into the supply air flow guide.

It is advantageous for there to be provided on the supply air flow guide connection a sealed region, by means of which the at least one hole in the connection device is sealed.

This sealed region may, for example, be formed as a cylindrical inner face of the clean air line connection against which at least one O-ring of the first connection device abuts for sealing.

The sealing or the sealed region ensures that the hole no longer connects the inner space to the environment. As soon as the connection device is correctly connected to the supply air flow guide connection, the environment and the inner space are separated from each other or no longer connected.

It is further advantageous for the supply air flow guide connection to have at least one stop for a non-return valve, wherein the non-return valve is provided in the first connection device.

The stop for the non-return valve is a passive component which can readily be provided in the clean air line connection and which is also not disruptive at that location when a connection device without a corresponding non-return valve is connected to a structurally identical, clean air guide. The stop is then simply non-operational.

A motor vehicle having an internal combustion engine and a ventilation line having a described connection device are further intended to be described herein.

The hole in the connection device forms (preferably together with a pressure sensor on the ventilation line) a diagnosable interface which can be evaluated, for example, by an on-board diagnostic system of a motor vehicle in order to determine whether the connection device is correctly secured to a supply air flow guide connection.

The diagnosable interface is preferably formed by the different components explained below. The specific feature of the device is that the diagnosable interface is completely a component of the ventilation device. It is in particular formed only by components which are arranged between the first connection device and the second connection device on a ventilation line or on a ventilation device. By the diagnosable interface being integrated in the ventilation line, at least a first or a second connection device of the ventilation line can be configured in a particularly simple manner. In particular, adaptations to the diagnosable interface have to be carried out (only) in the ventilation device. Preferably, the first connection device which is connected to the supply air flow guide is configured in such a manner that the components which are particularly relevant to the diagnosable interface are arranged at this location. This means that the diagnosable interface is preferably integrated in the first connection device. It is consequently no longer necessary to arrange the diagnosis interface in the supply air flow guide or in the structural housing space thereof or in a clean air line connection which is arranged on the supply air flow guide for the first connection device. Instead, the diagnosis interface can advantageously be formed by the construction of the connection device. Different variants of the ventilation device which are required during assembly in an internal combustion engine and in particular different variants of the supply air flow guide can thereby be dispensed with. Different variants of the ventilation line and the supply air flow line which can be dispensed with are in particular those with or without interfaces for OBD devices. The supply air flow guide connection for the first connection device on the supply air flow guide can always remain unchanged. Only the first connection device which is a component of the ventilation line or which is connected to the ventilation line and not to the supply air flow line is varied in this instance. This is carried out by selectively providing at this location an adapted first connection device which, for example, may optionally be constructed with or without a diagnosable OBD interface.

Finally, the ventilation device according to the invention may advantageously be used in connection with internal combustion engines and in particular with the internal combustion engines used in motor vehicles.

The invention and the technical background are explained in greater detail below with reference to the Figures. It should be noted that the Figures illustrate particularly preferred construction variants of the invention, but are not limited thereto.

DETAILED DESCRIPTION OF THE DRAWINGS

Figure 1:
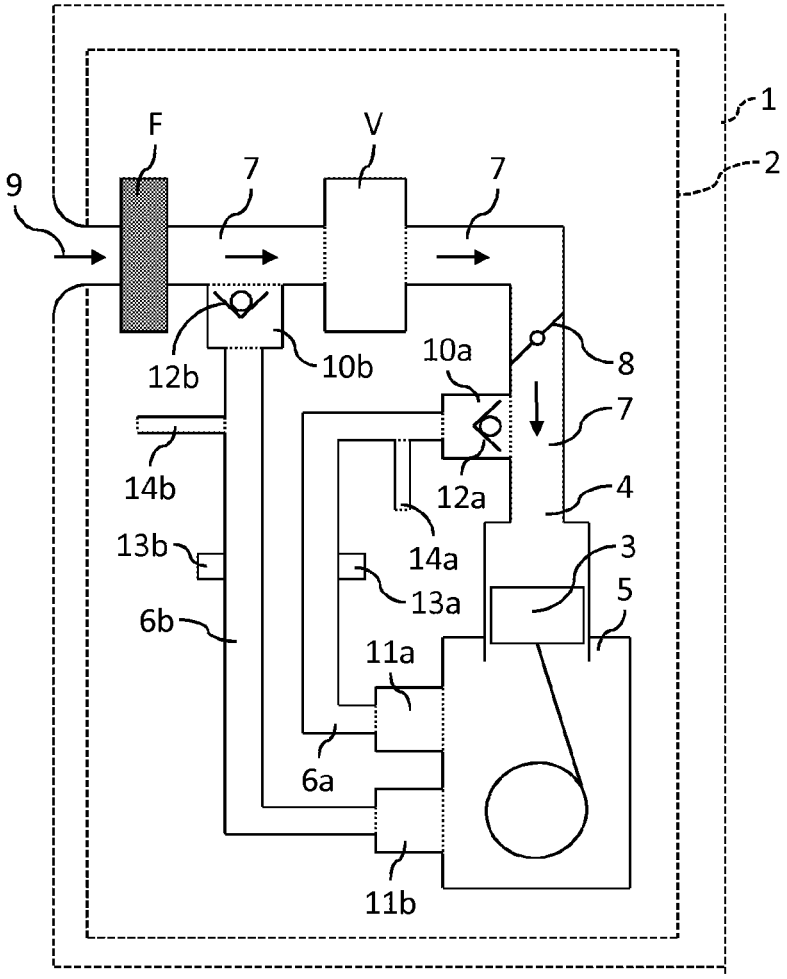
FIG. 1 is a schematic illustration of a vehicle having an internal combustion engine, whose ventilation devices have a connection device according to an embodiment of the invention.

FIG. 1 schematically illustrates a motor vehicle 1 which is driven by means of an internal combustion engine 2. The internal combustion engine 2 is driven by means of a piston 3, which carries out lifting movements which are guided in a combustion chamber 4. There is arranged below the piston 3 a crankcase 5 which is ventilated by means of a ventilation line 6*a*, 6*b*. The ventilation line 6 has a connection device 10*a*, 10*b* and another connection device 11*a*, 11*b*. The ventilation line is preferably part of a ventilation device and forms a module or a sub-assembly. The ventilation line 6*a*, 6*b* is guided with the connection device 10*a*, 10*b* on a supply air flow guide 7. The construction variant according to FIG. 1 has two ventilation lines 6*a*, 6*b*. A first ventilation line 6*a* with a connection device 10*a* and with another connection device 11*a* branches off at the crankcase 5 and opens downstream of a throttle valve 8 in the supply air flow guide 7. A second ventilation line 6*b* with a connection device 10*b* and with another connection device 11*b* branches off at the crankcase 5 and opens upstream of a compressor V and downstream of a filter F in the supply air flow guide 7.

Via the supply air flow guide 7, drawn-in ambient air which is cleaned by means of a filter F and which has been compressed by means of a compressor V is guided with a flow direction 9 to the combustion chamber 4. The opening with the connection device 11*a* downstream of the throttle location 8, when viewed in the flow direction 9, has the advantage that a reduced pressure is generally applied at that location so that the gas which is directed out of the crankcase 5 can reach the clean air guide 7 as a result of the reduced pressure. The opening with the connection device 11*b* between the filter F and the compressor V, when viewed in the flow direction 9, has the advantage that there is applied a reduced pressure at that location in operating situations in which the internal combustion engine 2 is acted on by the compressor V with a boost pressure.

On the ventilation lines 6*a*, 6*b* there is preferably in each case also a pressure sensor 13*a*, 13*b* by means of which a pressure can be established in the ventilation device 21. A tank ventilation connection 14*a*, 14*b* is also provided in each case on the ventilation lines 6*a*, 6*b* in order to connect a tank ventilation.

Figure 2:
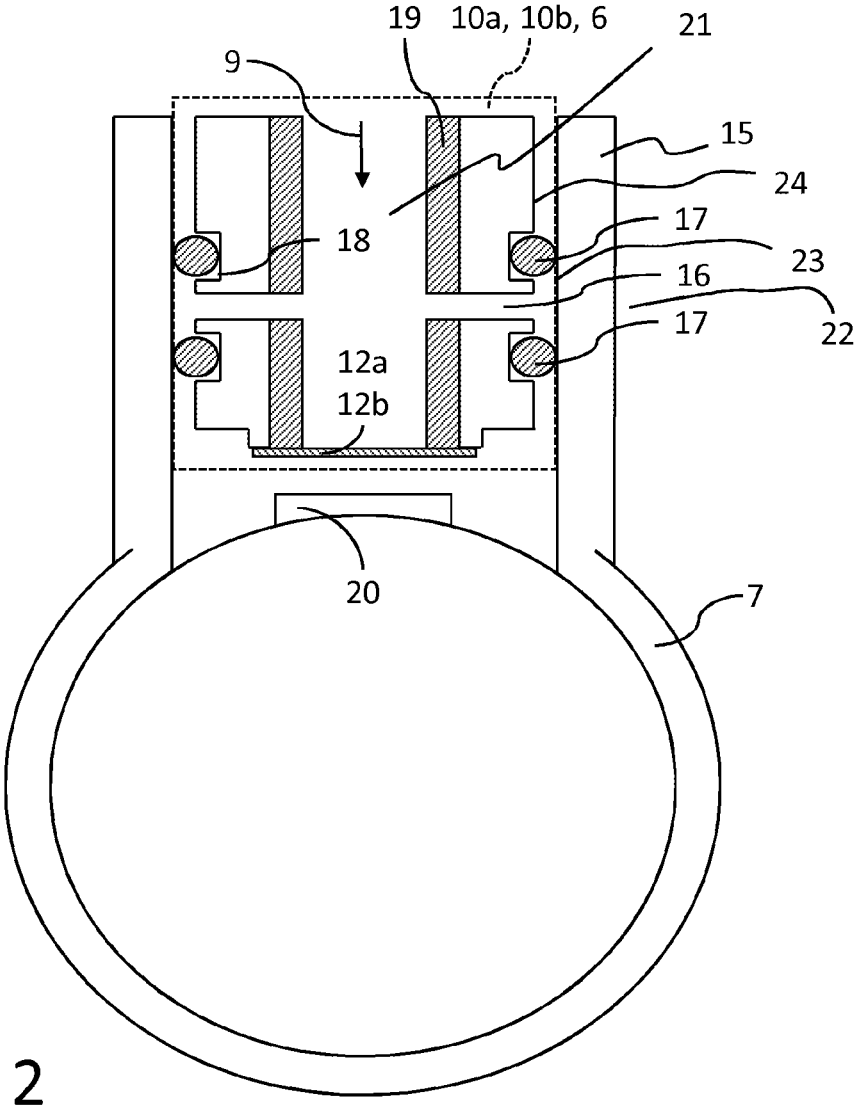
FIG. 2 is a partial view of the connection device described.

FIG. 2 now illustrates the first connection device 10*a*, 10*b* and the corresponding supply air flow guide connection 15 on the supply air flow guide 7 as an enlarged view. In the lower region, the supply air flow guide 7 is illustrated with a circular cross-section. Therefore, FIG. 2 shows a cross-section through the supply air flow guide 7. The ventilation line 6*a*, 6*b* is in this instance connected to the supply air flow guide 7 by means of a plug type connection, wherein this plug type connection is formed by the supply air flow guide connection 15 and the connection device 10*a*, 10*b*. The diagnosable interface 12 comprises in particular at least one hole (bore) 16. Downstream of the hole 16, when viewed in the flow direction 9, there is provided a non-return valve 12*a*, 12*b* which allows the gas flowing out of the crankcase to pass through in the direction of the flow direction 9. In the opposite direction, however, as a result of the non-return valve 12*a*, 12*b*, a return flow of gas from the clean air guide 7 back in the direction of the crankcase is prevented.

In order to ensure a fluid-tight connection between the supply air flow guide connection 15 and the ventilation line 6*a*, 6*b* or the connection device 10*a*, 10*b*, sealing device 17 are provided and are constructed in this instance as O-rings which are arranged in grooves 18 in an outer face 24 on the connection device 10*a*, 10*b*. These sealing device 17 which are constructed as O-rings serve in this instance not only to seal the connection device 10*a*, 10*b* in the supply air flow guide connection 15. They also serve to seal the at least one hole 16. Preferably, the at least one hole 15 is arranged between two sealing device 17 on the connection device 10*a*, 10*b*. Inside the connection device 10*a*, 10*b* there is also a heating device 19 which serves to produce and/or to distribute heat in the connection device 10*a*, 10*b*. On the supply air flow guide connection 15, there is also provided in this instance a stop 20, which the non-return valve 12*a*, 12*b* can strike in the connection device 10*a*, 10*b* if it is connected to the supply air flow guide connection 15. A maximum opening angle of the non-return valve 12*a*, 12*b* is thereby predetermined and a deformation of the non-return valve 12*a*, 12*b* can thus be prevented.

The sealed region 23 ensures that the hole 16 no longer connects the inner space 21 to the environment 22. As soon as the connection device 10*a*, 10*b* is correctly connected to the supply air flow guide connection 15, the environment 22 and the inner space 21 are separated from each other or are no longer connected.

Finally, it should be noted that the present invention is not limited to the embodiments illustrated here. Instead, numerous modifications of the invention are possible within the scope of the patent claims. In particular, using the present invention different variants with/without a non-return valve and/without heating are illustrated alone via the connection device for crankcases, ventilation lines and tank ventilation lines so that the component of the clean air guide can remain uniform. Furthermore, the invention can ensure that the ventilation device is monitored by means of the diagnosable interface 12 in such a manner that it is correctly installed and remains functional during operation.

LIST OF REFERENCE NUMERALS

1 Motor vehicle
2 Internal combustion engine
3 Piston
4 Combustion chamber
5 Crankcase
6*a* Ventilation line of a first ventilation device
6*b* Ventilation line of a second ventilation device
7 Supply air flow guide
8 Throttle flap
9 Flow direction
10*a* Connection device of a first ventilation device
10*b* Connection device of a second ventilation device
11*a* Additional connection device of a first ventilation device
11*b* Additional connection device of a second ventilation device
12*a* Non-return valve of a first ventilation device
12*b* Non-return valve of a second ventilation device
13*a* Pressure sensor of a first ventilation device
13*b* Pressure sensor of a second ventilation device
14*a* Tank ventilation connection of a first ventilation device (optional)
14*b* Tank ventilation connection of a second ventilation device (optional)
15 Supply air flow guide connection
16 Hole
17 Sealing device
18 Grooves
19 Heating device
20 Stop
21 Inner space
22 Environment
23 Sealed region
24 Outer face
F Filter
V Compressor

What is claimed is:

1. A connection device for connecting a ventilation line to a supply air flow guide of an internal combustion engine, comprising:

a connection device body that forms an end of the ventilation line and is configured to be inserted into a receiving member on the air supply flow guide so as to connect the ventilation line to the supply air flow guide;

a non-return valve for preventing a flow from the supply air flow guide into the ventilation line, wherein the non-return valve is arranged at a downstream end of the connection device body; and at least one hole which is arranged through the connection device body upstream of the non-return valve so as to connect an inner space of the connection device to an exterior environment of the connection device and to thereby form a defined leakage location that indicates an improper connection of the connection device to the ventilation line.

2. The connection device according to claim 1, further comprising:

a heating device integrated in the connection device.

3. The connection device according to claim 2, wherein the heating device is an electrical heating element.

4. The connection device according to claim 1, wherein the non-return valve is arranged directly downstream of the at least one hole.

5. A supply air flow guide for an internal combustion engine, comprising:

a supply air flow guide connection configured to operatively connect with a connection device having a ventilation line according to claim 1.

6. The supply air flow guide according to claim 5, wherein a sealed region is provided on the supply air flow guide connection, by which the at least one hole in the connection device is sealable.

7. The supply air flow guide according to claim 5, wherein the supply air flow guide connection has at least one stop for the non-return valve of the connection device.

8. A motor vehicle, comprising:

an internal combustion engine;

a ventilation line;

a supply air flow guide connection; and a connection device comprising:

a connection device body that forms an end of the ventilation line and is configured to be inserted into a receiving member on the air supply flow guide so as to connect the ventilation line to the supply air flow guide;

a non-return valve for preventing a flow from the supply air flow guide into the ventilation line, wherein the non-return valve is arranged at a downstream end of the connection device body;

at least one hole which is arranged through the connection device body upstream of the non-return valve so as to connect an inner space of the connection device to an exterior environment of the connection device and to thereby form a defined leakage location that indicates an improper connection of the connection device to the ventilation line; and at least one seal arranged on an outer face of the connection device, which seals the hole when the connection device is connected to a supply air flow guide connection on the supply air flow guide.

* * * * *